US006921225B1

(12) United States Patent
Hsu

(10) Patent No.: US 6,921,225 B1
(45) Date of Patent: Jul. 26, 2005

(54) STRUCTURE OF A BALLPOINT PEN WITH EXTENSIBLE CLOSING TOP

(76) Inventor: Yung-Ching Hsu, P.O. Box No. 6-57, Junghe, Taipei 235 (TW)

( * ) Notice: Subject to any disclaimer, the term of this patent is extended or adjusted under 35 U.S.C. 154(b) by 5 days.

(21) Appl. No.: 10/978,373

(22) Filed: Nov. 2, 2004

(51) Int. Cl.[7] ..... B43K 7/12
(52) U.S. Cl. ..... 401/117; 401/105; 401/104
(58) Field of Search ..... 401/117, 104, 105, 401/109, 112–114, 131

(56) References Cited

U.S. PATENT DOCUMENTS 370,881 A * 10/1887 Michael ..... 401/77
544,533 A * 8/1895 Harpfer ..... 401/69
1,827,619 A * 10/1931 Schroeder et al. ..... 401/62
6,273,627 B1 * 8/2001 Mittersinker et al. ..... 401/117
6,309,122 B1 * 10/2001 Wang ..... 401/112
6,474,889 B2 * 11/2002 Kato ..... 401/117
6,752,557 B1 * 6/2004 Hsieh ..... 401/117
6,773,185 B1 * 8/2004 Hsieh ..... 401/105
6,832,868 B2 * 12/2004 Hertwig et al. ..... 401/117

* cited by examiner

*Primary Examiner*—Khoa D. Huynh

(57) ABSTRACT

A ballpoint pen with extensible closing top structured to include a spring pen top, a handhold, an extensible pen body, a cap and a pen refill, wherein the extensible pen body embodies a two-stage configuration. Furthermore, a butt pin is configured interior of the cap, which penetrates interior of the extensible pen body and the handhold, and butts against a rear end of the spring pen top. When not in usage, a front section of the spring pen top covers the internal pen refill, and thus the pen refill is not exposed, whereas directly pulling backward on the extensible pen body thereby exposes the pen refill. Usage of the ballpoint pen is thus made considerably convenient.

1 Claim, 7 Drawing Sheets

STRUCTURE OF A BALLPOINT PEN WITH EXTENSIBLE CLOSING TOP

BACKGROUND OF THE INVENTION (a) Field of the Invention

The present invention relates to a structure of a ballpoint pen with extensible closing top, and more particularly to the ballpoint pen structured to comprise a spring pen top, a handhold, an extensible pen body, a cap and a pen refill. Control over advance and retreat of the front-end spring pen top is effectuated by pulling forward and backward on the extensible pen body, thereby achieving rapid opening of the ballpoint pen for immediate usage thereof. Furthermore, when the ballpoint pen is not in usage, structure of the ballpoint pen provides for protecting the pen refill by withdrawing the pen refill within the handhold.

(b) Description of the Prior Art

Conventional ballpoint pens can be divided into the following various types, including press-type, twist-type and cover-type, wherein the type indicates which method is utilized for opening the ballpoint pen for usage thereof. Referring to FIG. 1, which shows a ballpoint pen a adopting the most commonly cover-type method. The ballpoint pen a is divided into two major portions, namely a pen top a1 and a pen body a2. A pen refill a3 is disposed interior of the pen body a2. When not in usage, the pen top a1 is placed atop a front extremity of the pen body a2, thereby covering the pen body a2, and which is further utilized to protect the pen refill a3 from being damaged should the pen refill a3 knock against an object. When requiring using the ballpoint pen a, directly removing of the pen top a1 permits immediate usage of the ballpoint pen a, thus realizing extreme convenience in usage. However, outward appearance of the ballpoint pen a is relatively uninteresting, and relatively easily eliminated through market competition. Moreover, the pen top a1 is difficult to store and easily lost.

Hence, the inventor of the present invention has specifically developed an improved structure for a ballpoint pen so as to provide an extensible type opening and closing method. The ballpoint pen utilizes a structure comprising a spring pen top, a handhold, an extensible pen body, a cap and a pen refill. Control over advance and retreat of the front-end spring pen top is effectuated by pulling forward and backward on an extensible pen body, thereby achieving rapid opening of the ballpoint pen for immediate usage thereof. Furthermore, when the ballpoint pen is not in usage, structure of the ballpoint pen provides for protecting the pen refill by withdrawing the pen refill within the handhold. Usage of the ballpoint pen is thus made considerably easy, and embodies uniqueness, which assuredly complies with market requirements.

SUMMARY OF THE INVENTION

In light of aforementioned shortcomings of a conventional configuration, the inventor of the present invention, having accumulated years of experience in related arts, attentively and circumspectively carried out extensive study and exploration to ultimately design a completely new structure of a ballpoint pen with extensible closing top.

A primary objective of the present invention is to provide the ballpoint pen with a structure that utilizes pulling forward and backward on an extensible pen body to control advance and retreat of a front-end spring pen top, thereby achieving rapid opening of the ballpoint pen for immediate usage thereof, and, moreover, provides for protecting the pen refill.

In order to achieve the aforementioned objective, the structure of a ballpoint pen with extensible closing top is structured to comprise a spring pen top, a hand hold, an extensible pen body, a cap and a pen refill, wherein the extensible pen body embodies a two-stage configuration, and, moreover, can slide forward and backward. A butt pin is configured interior of the cap mounted on a frontal extremity of the ballpoint pen. The butt pin penetrates interior of the extensible pen body and the handhold, and butts against a rear end of the spring pen top. The spring pen top is structured to comprise a revolving cap, a central sleeve, a spring, a spring stop sleeve and an outer sleeve. The outer sleeve is first disposedly sleeved onto a frontal extremity of the central sleeve, whereupon the spring is configured on a rear end of the outer sleeve, and the spring stop sleeve is tightly disposed interior of a rear end of the central sleeve, thereby forming a sliding configuration that enables forward and backward movement therewith. Thereafter, the revolving cap is screwed onto the rear end of the outer sleeve.

According to the aforementioned structural configuration, during usage, the butt pin positioningly configured in the cap can butt against the rear end of the spring pen top by backward pulling on the extensible pen body, thereby controlling withdrawal of a front end of the front-end spring pen top, and exposing a front end of the pen refill configured interior of the extensible pen body, thus achieving rapid opening of the ballpoint pen for immediate usage thereof. Upon storing the ballpoint pen, merely pushing forward on the extensible pen body actuates the butt pin to butt against the rear end of the spring pen top, and thereby control forward movement of the front end of the front-end spring pen top, which thus effectuates covering the front end of the pen refill configured interior of the extensible pen body with the spring pen top, and realizes protecting the pen refill by withdrawing same within the hand hold when not in usage. Usage of the ballpoint pen is thus made considerably easy, and embodies uniqueness.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
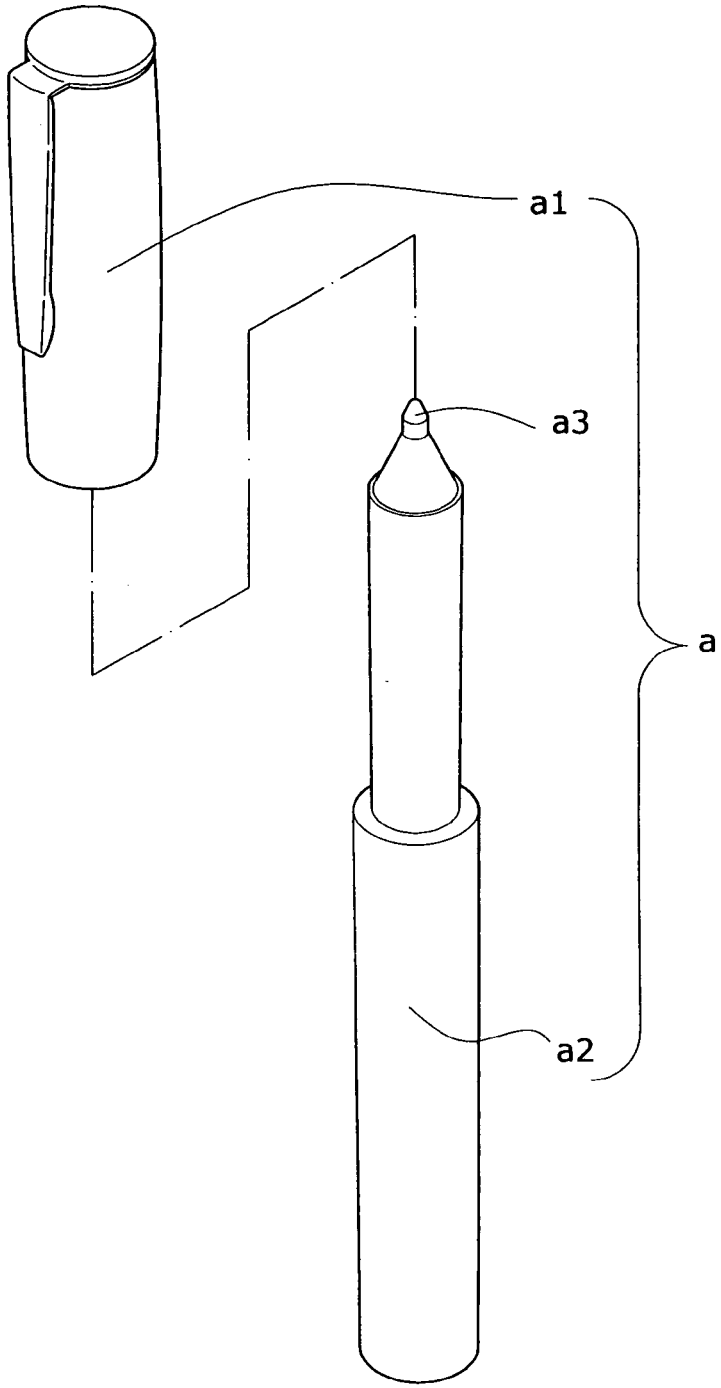
Fig.1 (Prior Art)
FIG. 1 shows a structural elevational view of a conventional ballpoint pen.
Figure 2:
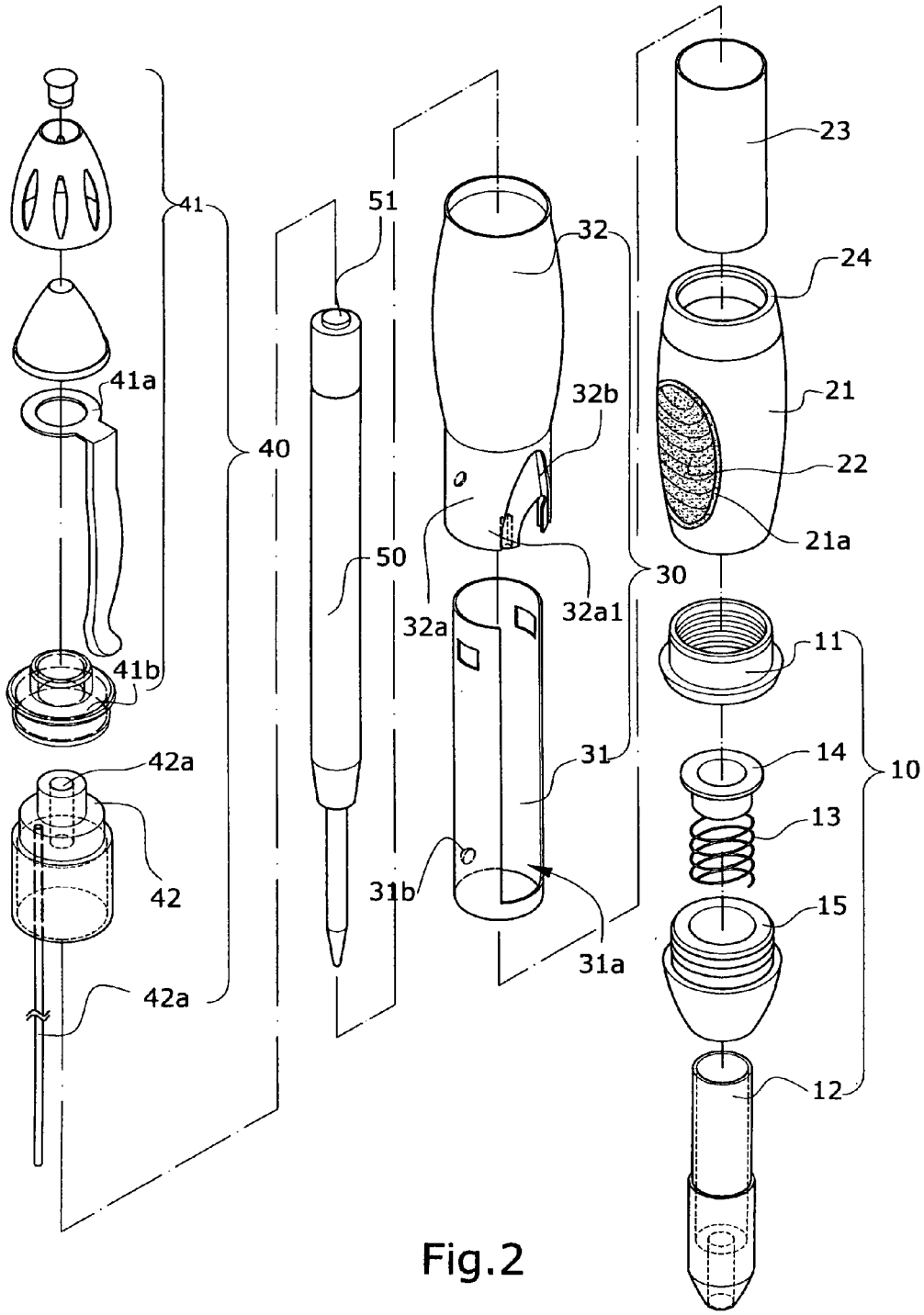
FIG. 2 shows an exploded elevational view according to the present invention.
Figure 3:
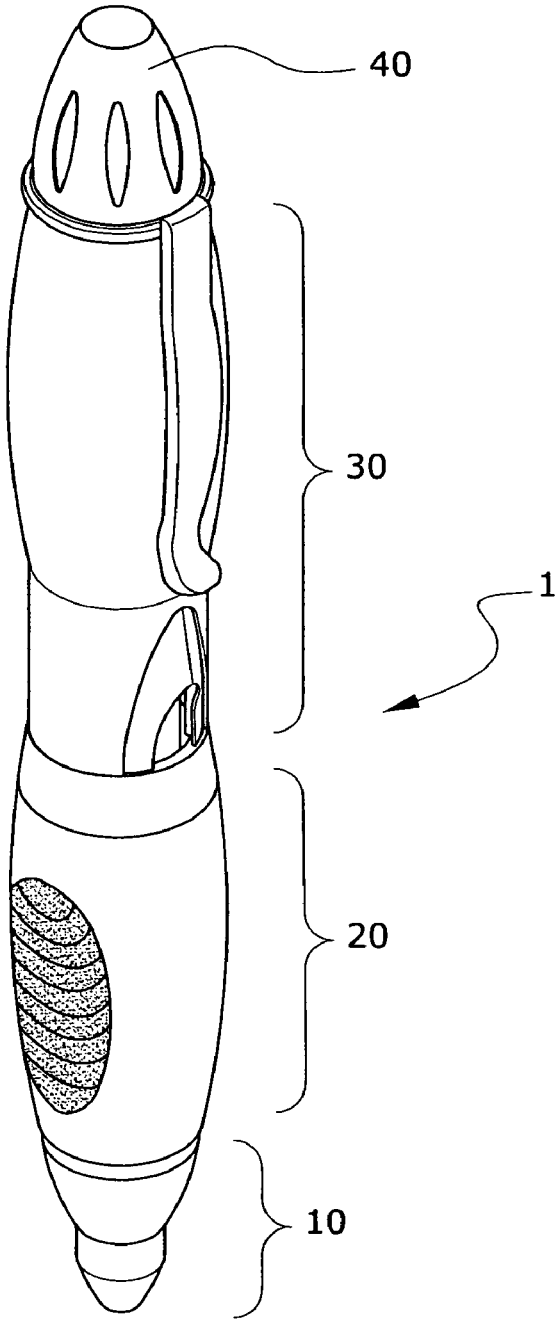
FIG. 3 shows an assembled elevational view according to the present invention.
Figure 4A:
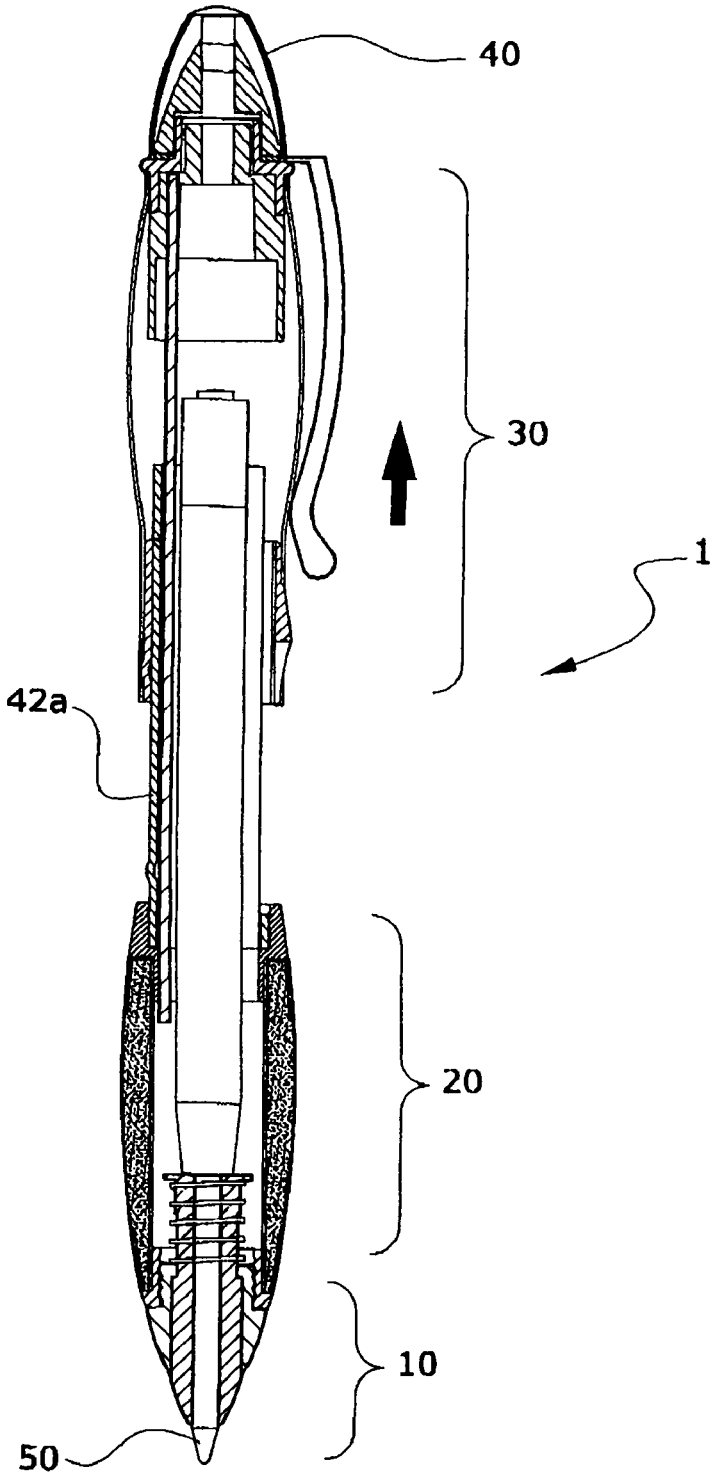
FIG. 4A shows a schematic view depicting opening operation according to the present invention (10).
Figure 4B:
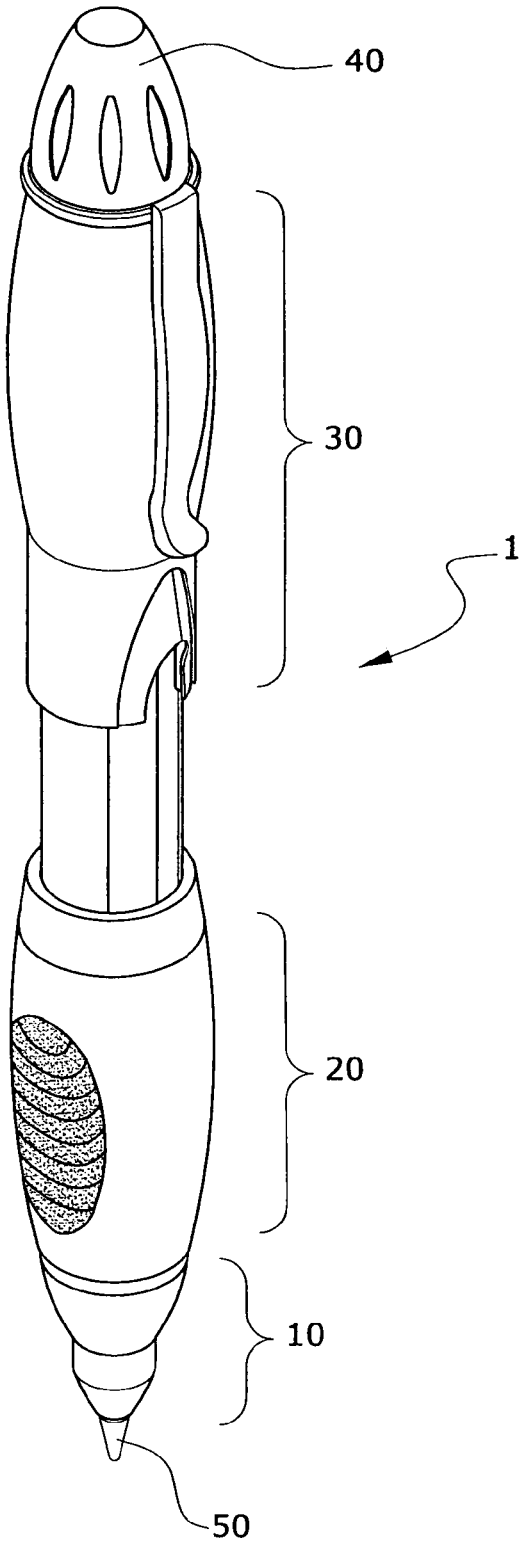
FIG. 4B shows a cross-sectional view depicting open configuration according to the present invention (2).
Figure 4C:
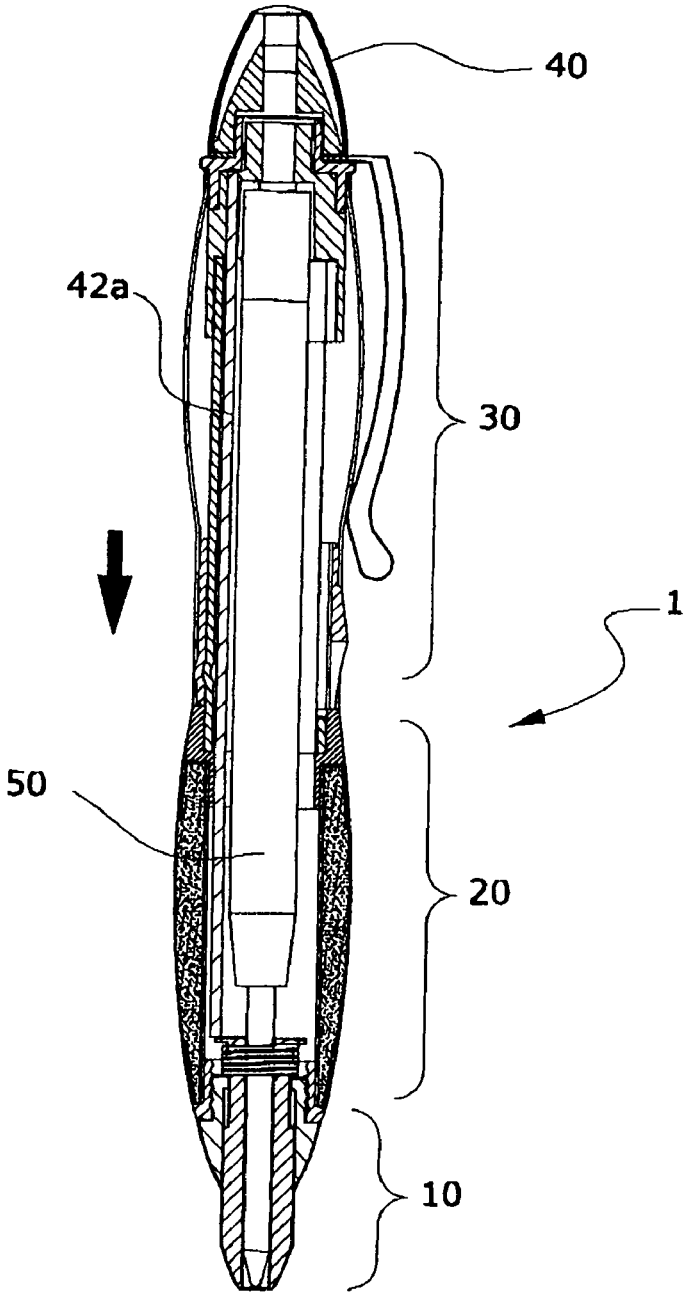
FIG. 4C shows a schematic view depicting closing operation according to the present invention (1).
Figure 4D:
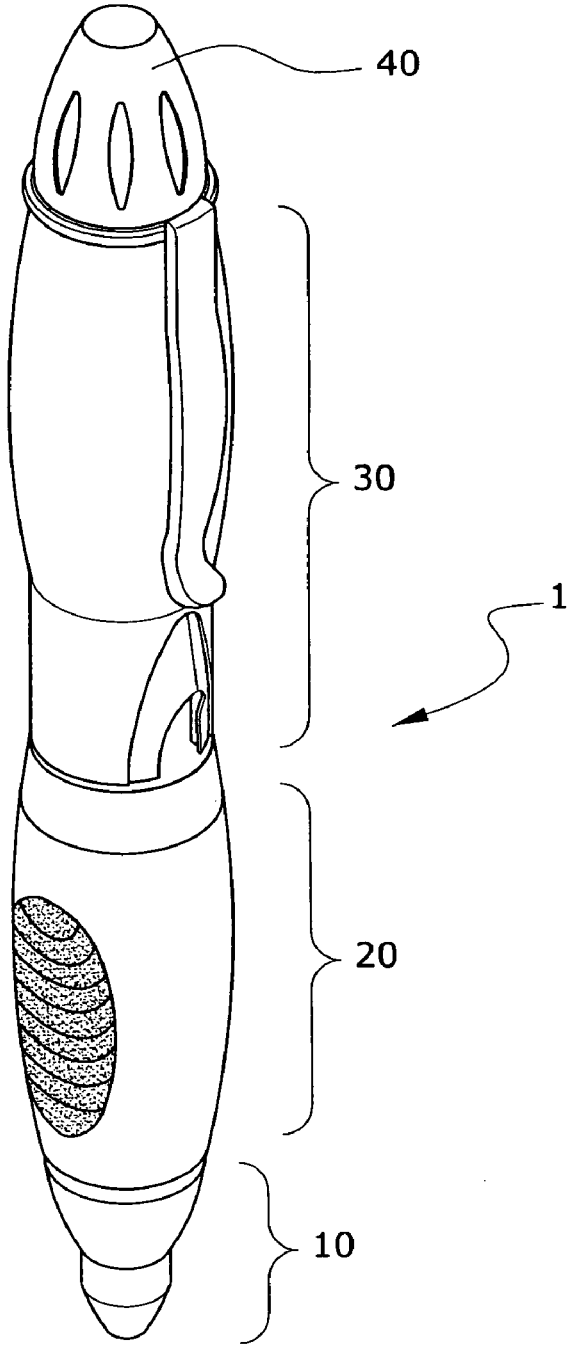
FIG. 4D shows a cross-sectional view depicting closed configuration according to the present invention (2).

Referring to FIGS. 2 and 3, which show a structure of a ballpoint pen with extensible closing top of the present invention, and which is structured to comprise a spring pen top 10, a handhold 20, an extensible pen body 30, a cap 40 and a pen refill 50. Wherein:

The spring pen top 10 is configured on a frontal extremity of entire ballpoint pen 1, and which is structured to comprise a revolving cap 11, a central sleeve 12, a spring 13, a spring stop sleeve 14 and an outer sleeve 15. The outer sleeve 15 is first disposedly sleeved onto a frontal extremity of the central sleeve 12, whereupon the spring 13 is configured on a rear end of the outer sleeve 15, and the spring stop sleeve 14 is tightly disposed interior of a rear end of the central sleeve 12, thereby forming a sliding configuration that enables forward and backward movement therewith. Thereafter, the revolving cap 11 is screwed onto the rear end of the outer sleeve 15.

The hand hold 20 is disposedly sleeved onto a rear end of the revolving cap 11 of the spring pen top 10, and which is structured to comprise a hand hold body 21, a rubber sleeve 22, a hand hold sleeve 23 and a ring 24. Wherein an outer side wall of the hand hold sleeve 23 is first sheathed with the rubber sleeve 22, whereafter, the aforementioned assembled structure is sheathed with the hand hold body 21 at an appropriate position thereof so that the rubber sleeve 22 is allowed to penetrate through an elliptical hole 21*a* defined in the hand hold body 21. Thereafter, the ring 24 is disposedly mounted on a rear end of the handhold body 21.

The extensible pen body 30 is structured to comprise an inner sleeve 31 and an outer slide sleeve 32. A front end of the inner sleeve 31 is sleeved within the ring 24. One side of the inner sleeve 31 is provided with a rectangular hole 31*a*. A plastic slide piece 32*a* is disposedly mounted within the outer slide sleeve 32, and two protruding strips 32*a*1 inwardly extend from the plastic slide piece 32, thereby enabling the rectangular hole 31*a* of the inner sleeve 31 to clasp exterior of the two protruding strips 32*a*1. Furthermore, a clasp point 31*b* extends from another side exterior wall of the rectangular hole 31*a* of the inner sleeve 31, and which can clasp within a locating hole 32*b* of the outer slide sleeve 32.

The cap 40 is structured to comprise a metal cover 41 and a plastic inner lining 42. The metal cover 41 is provided with a pen clip 41 and a front cover stopper 41*b*, and the plastic inner lining 42 is configured on a front end of the front cover stopper 41*b*. A butt pin 42*a* is configured at an appropriate position in the plastic inner lining 42. The butt pin 42 penetrates and is thereby configured interior of the extensible pen body 30 and the handhold 20, and butts against a rear end of the spring pen top 10. Furthermore, central of the plastic inner lining 42 is provided with an airway 42*b*.

The pen refill 50 is disposed interior of the extensible pen body 30 and the handhold 20. A rear end of the pen refill 50 is provided with a locating portion 51, which is utilized to fixedly configure same in a front end of the plastic inner lining 42 of the cap 40.

Referring to FIGS. 4A to 4D, according to the aforementioned structural configuration, during usage, the butt pin 42*a* positioningly configured in the cap 40 can butt against the rear end of the spring pen top 10 by backward pulling on the extensible pen body 30, thereby controlling withdrawal of a front end of the front-end spring pen top 10, and exposing a front end of the pen refill 50 configured interior of the extensible pen body 30, thus achieving rapid opening of the ballpoint pen 1 for immediate usage thereof. Upon storing the ballpoint pen 1, merely pushing forward on the extensible pen body 30 actuates the butt pin 42 to butt against the rear end of the spring pen top 10, and thereby control forward movement of the front end of the front-end spring pen top 10, which thus effectuates covering the front end of the pen refill 50 configured interior of the extensible pen body 10 with the spring pen top 10, and realizes protecting the pen refill 50 by withdrawing same within the hand hold 20 when not in usage.

In conclusion, the structure of a ballpoint pen with extensible closing top of the present invention utilizes a combination of the extensible pen body 30 and the front-end spring pen top 10 to control advance and retreat of the front-end spring pen top 10 by pulling forward and backward on the extensible pen body 30, thereby achieving rapid opening of the ballpoint pen for immediate usage thereof. Advancement and practicability of the present invention comply with essential elements as required for application of a new patent model. Accordingly, a new patent application is proposed herein.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A structure of a ballpoint pen with extensible closing top comprising a spring pen top, a handhold, an extensible pen body, a cap and a pen refill, and which utilizes drawing back of the extensible pen body to ready the ballpoint pen for usage, moreover, when the ballpoint pen is not in usage, a front end of the spring pen top can be pushed forward, thereby covering the pen refill; and characterized in that:

the spring pen top is configured on a frontal extremity of entire ballpoint pen, and which comprises a revolving cap, a central sleeve, a spring, a spring stop sleeve and an outer sleeve, the outer sleeve is first disposedly sleeved onto a frontal extremity of the central sleeve, whereupon the spring is configured on a rear end of the outer sleeve, and the spring stop sleeve is tightly disposed interior of a rear end of the central sleeve, thereby forming a sliding configuration that enables forward and backward movement therewith, thereafter, the revolving cap is screwed onto the rear end of the outer sleeve;

the hand hold is disposedly sleeved onto a rear end of the revolving cap of the spring pen top, and which comprises a hand hold body, a rubber sleeve, a hand hold sleeve and a ring, wherein an outer side wall of the hand hold sleeve is first sheathed with the rubber sleeve, whereafter, the aforementioned assembled structure is sheathed with the hand hold body at an appropriate position thereof so that the rubber sleeve is allowed to penetrate through an elliptical hole defined in the hand hold body, thereafter, the ring is disposedly mounted on a rear end of the hand hold body;

the extensible pen body comprises an inner sleeve and an outer slide sleeve, a front end of the inner sleeve is sleeved within the ring, one side of the inner sleeve is provided with a rectangular hole, a plastic slide piece is disposedly mounted within the outer slide sleeve, and two protruding strips inwardly extend from the plastic slide piece, thereby enabling the rectangular hole of the inner sleeve to clasp onto exterior of the two protruding strips, moreover, a clasp point extends from another side exterior wall of the rectangular hole of the inner sleeve, and which can clasp within a locating hole of the outer slide sleeve;

the cap comprises a metal cover and a plastic inner lining, the metal cover is provided with a pen clip and a front cover stopper, and the plastic inner lining is configured on a front end of the front cover stopper, a butt pin is configured at an appropriate position in the plastic inner lining, the butt pin penetrates and is thereby configured interior of the extensible pen body and the hand hold, and butts against a rear end of the spring pen top;

the pen refill is disposed interior of the extensible pen body and the handhold, a rear end of the pen refill is provided with a locating portion, which is utilized to fixedly configure same in a front end of the plastic inner lining of the cap.

* * * * *